United States Patent [19]

Helmick

[11] Patent Number: 4,544,176

[45] Date of Patent: Oct. 1, 1985

[54] TRACTOR MOUNTED HYDRAULIC CONTROL MECHANISM FOR AN EARTH WORKING TOOL

[75] Inventor: James L. Helmick, Estherville, Iowa

[73] Assignee: Shaver Manufacturing Co., Graettinger, Iowa

[21] Appl. No.: 550,776

[22] Filed: Nov. 14, 1983

[51] Int. Cl.[4] ..... B60D 3/00; E21B 15/04

[52] U.S. Cl. ..... 280/481; 173/42; 280/492

[58] Field of Search ..... 280/481, 492; 173/39, 173/42, 44

[56] References Cited

U.S. PATENT DOCUMENTS

| | | | |
|---|---|---|---|
| 2,662,736 | 12/1953 | Abrams | 173/42 |
| 2,928,322 | 3/1960 | Spitzer | 173/42 |
| 2,940,267 | 6/1960 | Shaver | 173/46 |
| 3,088,385 | 5/1963 | Dorkins et al. | 173/44 |
| 4,245,714 | 1/1981 | Kersey | 280/492 |

*Primary Examiner*—John A. Pekar

*Attorney, Agent, or Firm*—Rudolph L. Lowell

[57] ABSTRACT

A control mechanism for selectively positioning an upright earth working tool carried by a portable vehicle having a source of pressurized hydraulic fluid. The control mechanism includes a shaft rotatably carried on a horizontal base plate at the front end of the vehicle, and pivotally connected to a carrier member for the earth working tool for tilting movement of the carrier member laterally of the vehicle. A first hydraulic cylinder assembly for longitudinally tilting the working tool is pivotally connected at its rearward end on the shaft and at its forward end to the carrier member. A second hydraulic cylinder assembly for tilting the carrier member transversely of the vehicle has one end pivotally mounted on the base plate and is pivotally mounted at its other end to the shaft so that on rotation of the shaft the carrier member is tilted transversely. Each hydraulic cylinder assembly may be independently moved so that the earth working tool may be optimally positioned with respect to the level or grade of the terrain.

4 Claims, 5 Drawing Figures

TRACTOR MOUNTED HYDRAULIC CONTROL MECHANISM FOR AN EARTH WORKING TOOL

The invention relates generally to hydraulically adjusted earth working tools, and, more specifically, to a hydraulic control mechanism for selectively adjusting an upright tractor-mounted earth auger or post driver relative to the ground surface.

BACKGROUND OF THE INVENTION

Earth working tools are commonly used for a number of tasks, including trenching, scraping, boring, post hole digging, and so on. The tools often form part of a self-propelled vehicle which also supplies power to the earth working tool. The number and variety of tasks to be performed by the earth working tool demand versatility in positioning the tool with respect to the grade or level of the ground. The vehicle is ordinarily limited to a fixed position with respect to the supporting ground surface. Accordingly, it is necessary to selectively adjust the position of an upright working tool with respect to the portable vehicle upon which it is mounted in order to perform the task for which the tool is to be used.

In driving fence posts or in digging post holes it is desirable that the post be driven or the hole be dug in a vertical direction. A post driver, for example, rigidly mounted on a tractor would be incapable of driving vertical posts.

An apparatus for manually adjusting the position of a post driving device with respect to the ground surface is disclosed in U.S. Pat. No. 2,940,267. A device having three hydraulic cylinders for adjusting the angle of an upright earth boring apparatus, and disclosed in U.S. Pat. No. 3,576,218, is capable of only a limited lateral adjustment of the tool and utilizes a pair of the cylinders for longitudinal tool adjustment. This difficulty is solved by the present invention which provides for an upright post driver being selectively oriented with respect to the tractor in any direction to vertically drive posts in uneven terrain.

SUMMARY OF THE INVENTION

The present invention provides an improved mechanism for positioning with respect to the ground surface, a post driver or other earth engaging or moving tool. The mechanism includes a base plate rigidly mounted to the front end of a portable vehicle and having a shaft rotatably mounted thereon for rotation about an axis extended longitudinally of the vehicle. The shaft is pivotally attached at its forward end to the earth working tool to provide for the pivoting of the tool about an axis extended transversely of the vehicle.

A first hydraulic cylinder for tilting the tool longitudinally of the vehicle extends axially of the shaft with its rearward end pivotally attached to the rear end of the shaft, and its forward end pivoted to the earth working tool. A second hydraulic cylinder extended transversely of the shaft is pivotally mounted at one end to the shaft and at its other end to the base plate. Extension and retraction of the second hydraulic cylinder rotates the shaft about its longitudinal axis whereby to tilt the tool transversely of the vehicle.

Accordingly, the primary object of the invention is to provide a hydraulic control mechanism for efficiently and positively positioning an upright earth working tool mounted on a portable vehicle relative to the ground surface.

DETAILED DESCRIPTION OF A PREFERRED EMBODIMENT

Figure 1:
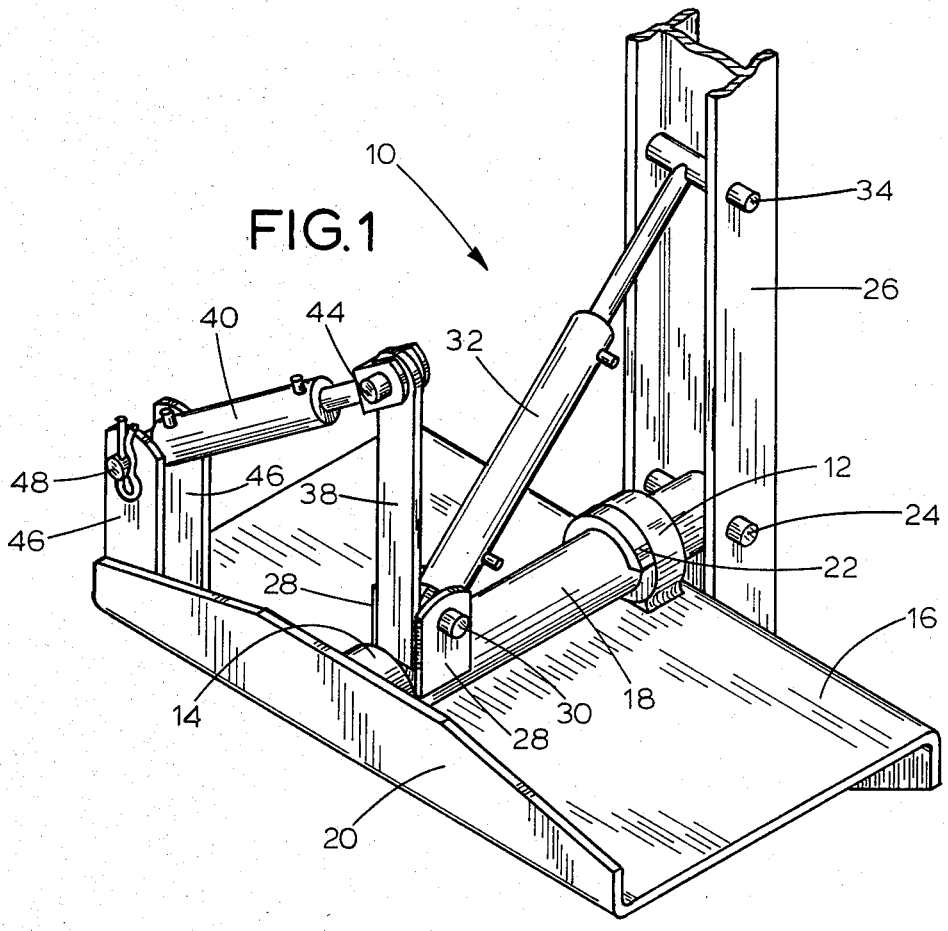
FIG. 1 is a perspective view of the invention particularly showing the hydraulic cylinder assembly for laterally and longitudinally pivoting the earth working tool.

Referring to FIG. 1, the hydraulic control mechanism of this invention, indicated generally at 10, includes a base plate 16 mountable on the front end of a farm tractor and having secured thereon a forward bearing collar 12 and a rear bearing collar 14, for rotatably receiving a horizontal shaft or tube 18. The rear bearing collar 14 has its rearward face in abutting engagement with an upright stop plate 20 integral with and projected upwardly from the rear side of the base plate 16. An arcuate stop member 22 secured to the shaft 18 rearwardly of and adjacent to the forward bearing collar 12 limits forward longitudinal movement of the shaft 18. Rearward longitudinal movement of the shaft 18 is limited by the contact engagement of the rear face of the shaft 18 with the vertical stop plate 20.

The shaft 18, adjacent its forward end, carries a transverse cross pin 24 for pivotal connection with an upright carrier member or mounting channel 26 for an earth engaging device. The pin 24 extends between and is supported in the rearwardly projected legs of the carrier member 26. The carrier member is thus supported forwardly of the base plate 16 for pivotal movement about an axis which intersects the axis of the shaft 18 and a longitudinal axis of the carrier member 26. Rotation of the shaft 18 about its axis thus causes a concurrent and unit rotation therewith of the carrier member 26.

Rotation of the shaft 18 about its axis is accomplished by means including a pair of transversely opposite upright ears 28 secured to opposite sides of the shaft 18 at positions forwardly of and adjacent the rear bearing collar 14. Secured to and positioned between the ears 28 is an upright arm 38, which is also attached at its lower end to the shaft 18. A first hydraulic assembly 40 extended transversely of the shaft 18 has the inner end thereof pivotally attached at 44 to the upper end of the arm 38 with the axis of the pivot 44 parallel to the axis of the shaft 18. The outer end of the hydraulic cylinder 40 is received between and pivotally supported at 48 on a pair of upright support ears 46 on the base plate 16. It is seen, therefore, that on extension and retraction of the cylinder assembly 40, the shaft 18 is rotatable about its axis to provide for a lateral tilting movement of the carrier member 26.

A second hydraulic cylinder assembly 32 has the axis thereof in a vertical plane common to the axis of the shaft 18. The cylinder assembly 32 extends upwardly and forwardly at an acute angle with respect to the shaft 18 and has the lower rear end thereof positioned between and pivotally connected at 30 to the upright ears 28 forwardly of the upright arm 38. The upper forward end of the cylinder assembly 32 is pivoted at 34 to the carrier channel 26, with the axis of the pivots 24 and 34 located in a common vertical plane.

The hydraulic cylinder assembly 32, carrier member 26 and shaft 18 are thus rotated as a unit about the axis of the shaft 18 in response to the operation of the hydraulic cylinder assembly 40 to laterally tilt the carrier member. At any laterally tilted position of the carrier member it may be tilted longitudinally of the shaft 18 by actuation of the cylinder assembly 32. It is apparent of course that actuation of the cylinder assemblies 32 and 40 may take place independently or concurrently.

Figure 2:
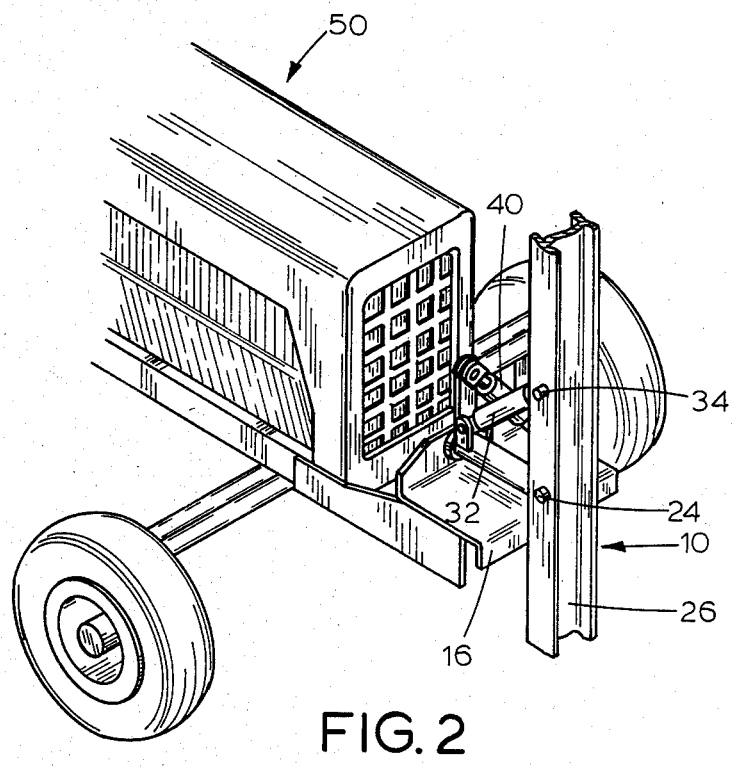
FIG. 2 is a perspective view of the front end of a tractor showing the assembly relation therewith of the control mechanism of this invention.

The base plate 16 is rigidly attached to the forward end of a portable vehicle such as a tractor 50 illustrated in FIG. 2. The tractor 50 is of a usual farm type equipped with a source of pressurized hydraulic fluid for the hydraulic cylinders 32 and 40 (FIG. 1) as will be more fully hereinafter described.

Figure 3:
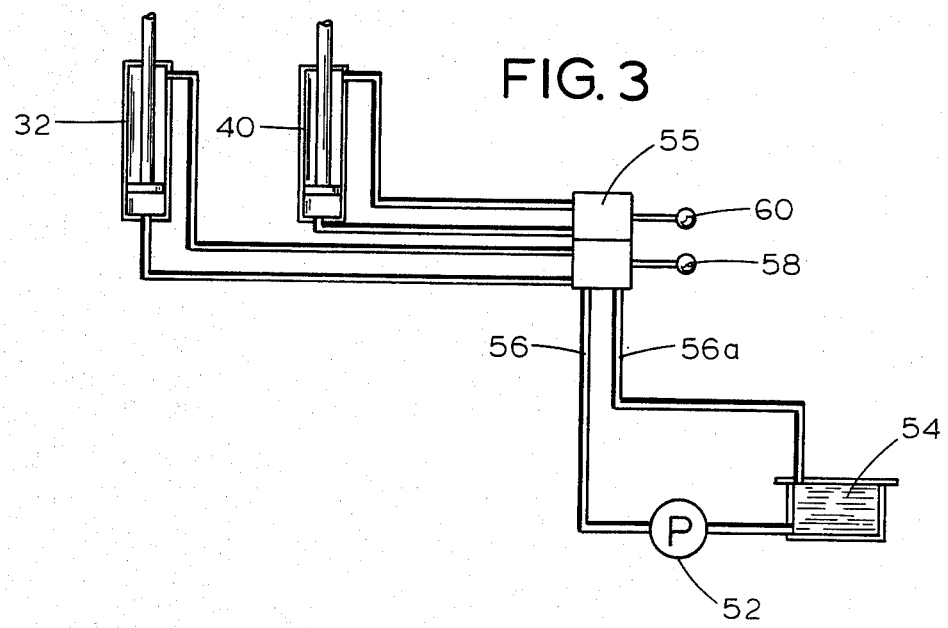
FIG. 3 is a schematic diagram of the hydraulic system for the control mechanism.

The hydraulic cylinders 32 and 40 are of double-acting type as shown schematically in FIG. 3. A pump 52 on the tractor supplies fluid to the cylinder assemblies 32 and 40 from a reservoir 54 through feed and return lines 56 and **56*a*, respectively, operatively associated with a control valve unit 55 having operating levers 58 and 60 for the cylinder assemblies 32 and 40**, respectively.

Figure 4:
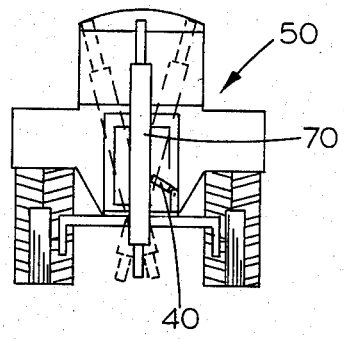
FIG. 4 is a front diagrammatic view of a post driver mounted on a tractor showing laterally moved positions therefor.
Figure 5:
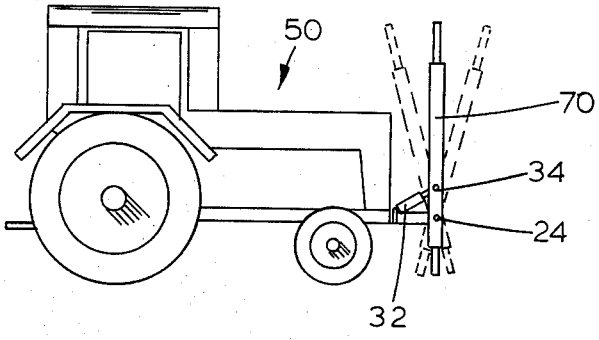
FIG. 5 is a side diagrammatic view of the post driver mounted on a tractor showing longitudinally moved positions therefor.

In use, and referring to FIG. 1, the carrier channel 26 is tilted longitudinally of the shaft 18 about the pivot 24 by extension and retraction of the cylinder assembly 32 (FIG. 5). The carrier channel 26 is laterally tilted about the longitudinal axis of the shaft 18 on extension and retraction of the cylinder assembly 40 (FIG. 4).

In a one embodiment of the invention, an earth working tool, such as a post driver and puller, illustrated in FIG. 4 at 70 is attached to or is integral with the carrier channel 26 (FIG. 1) substantially as described in U.S. Pat. No. 2,940,267. The post driver 70 may be pivoted both longitudinally and laterally of the tractor 50 since the longitudinal axis of the shaft 18 is parallel to the longitudinal axis of the tractor 50. Reciprocation of the cylinder 40 laterally pivots the post driver 70 between the two positions illustrated by the broken lines in FIG. 4. In a like manner, reciprocation of the cylinder 32 longitudinally pivots the post driver 70 between the two limiting positions illustrated by the broken lines in FIG. 5.

By virtue of the arrangement of the channel pivots 24 and 34 in a common plane and in a parallel relation with the pivot 30, and the arrangement of the pivots 44 and 48 parallel to the axis of the shaft 18, the longitudinal and lateral tilting movements of the carrier channel 26 and, in turn of the post driver 70, may occur together or separately so that the carrier channel 26 may be oriented to any position within the limits of linear extension of the cylinder assemblies 32 and 40. Preferably, the carrier channel 26 may be tilted laterally or longitudinally at least 15 degrees from the vertical position therefor. The invention 10 may, therefore, be used to set and drive posts vertically though the tractor 50 (FIG. 2) may be as much as 15 degrees away from level.

Although the invention has been described with respect to a preferred embodiment thereof it is to be understood that it is not to be so limited, since modifications and changes can be made therein with in the scope of the invention as defined in the following claims.

I claim:

1. A control mechanism for selectively positioning a vehicle mounted upright tool relative to the supporting terrain, said mechanism comprising:

(a) a horizontal base plate rigidly mounted adjacent the front end of the vehicle;

(b) a shaft rotatably mounted on the base plate for rotation about an axis extended longitudinally of the vehicle, having a rear end and a front end located forwardly of said base plate;

(c) an upright carrier member for said tool pivotally connected at a first position thereon to the front end of said shaft for tilting movement longitudinally of the vehicle;

(d) a first linearly extendible and retractable power means extended longitudinally of the vehicle for longitudinally tilting the carrier member having one end pivotally connected to said shaft adjacent the rear end thereof, and an opposite end pivotally connected to said carrier member at a second position thereon spaced upwardly from said first position thereon, (e) a second linearly extendible and retractable power means extended transversely of the vehicle for laterally tilting the carrier member having one end pivotally connected to said shaft, rearwardly of said first power means, and the other end thereof pivotally mounted on said base plate; and (f) means on the vehicle for concurrently and separately operating said first power means and said second power means.

2. The control mechanism as defined in claim 1, wherein:

(a) the pivotal connection of the first power means with the carrier member, and the pivotal connection of the shaft and the carrier member have the axes thereof in a parallel relation in a common plane extended transversely of said shaft and in a parallel relation with the pivotal connection of the first power means with the shaft for all moved positions of the carrier member.

3. The control mechanism as defined in claim 2, including:

(a) a first upright support means on said base plate laterally spaced from the rear end of said shaft, and (b) a second upright support means on said shaft rearwardly of said first power means, (c) said second power means extended between and pivotally connected to said first support means and said second support means adjacent the upper ends thereof.

4. The control mechanism as defined in claim 3, wherein:

(a) said first power means from the one end thereof is inclined upwardly and forwardly to said carrier member; and (b) said second power means from the second upright support means is inclined downwardly and laterally toward said first upright support means at all moved positions of the carrier member.

* * * * *